US005141466A

United States Patent [19]

Catizone

[11] Patent Number: 5,141,466

[45] Date of Patent: Aug. 25, 1992

[54] DOLL CONSTRUCTION

[76] Inventor: Robert D. Catizone, 4910 Oakridge Dr., Pittsburgh, Pa. 15227

[21] Appl. No.: 72,781

[22] Filed: Jul. 13, 1987

[51] Int. Cl.[5] ..... A63H 3/36

[52] U.S. Cl. ..... 446/391

[58] Field of Search ..... 446/321, 372, 391; 40/159

[56] References Cited

U.S. PATENT DOCUMENTS 1,428,677 9/1922 Barry ..... 446/371 X 2,199,049 4/1940 Greenberg ..... 446/391 X 3,950,580 4/1976 Boudet ..... 40/159 X 4,020,586 5/1977 Benner ..... 446/321 X 4,573,927 3/1986 Newman ..... 446/321 X

*Primary Examiner*—Mickey Yu

*Attorney, Agent, or Firm*—William J. Ruano

[57] ABSTRACT

A doll having a facial portion including a cut-out of round or of oblong shape into which a cardboard, photograph of a child's face, and transparent window may be inserted and either temporarily or permanently attached to the cut-out portion.

1 Claim, 1 Drawing Sheet

DOLL CONSTRUCTION

This invention relates to a doll construction and, more particularly, to the facial portion thereof.

BACKGROUND OF THE INVENTION

There are numerous designs of dolls on the market but one disadvantage is that they are not personalized.

SUMMARY OF THE INVENTION

An object of the present invention is to overcome the above named disadvantage by providing a doll in which the facial portion contains a portrait of the child who will carry the doll or a portrait of a relative, friend or famous personality. Such portrait is contained in a transparent window portion of the face and may be either permanently or temporarily retained in such portion.

BRIEF DESCRIPTION OF THE DRAWINGS

Referring more particularly to the drawings.

DESCRIPTION OF THE PREFERRED EMBODIMENTS

Figure 1:
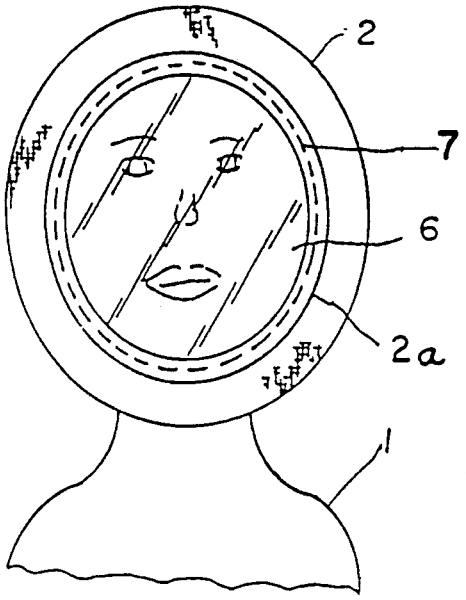
FIG. 1 shows a front view and FIG. 2 shows a side view of only the head portion of a doll of any desired shape embodying the principles of the present invention, showing a permanently mounted photograph of the face of a person.
Figure 2:
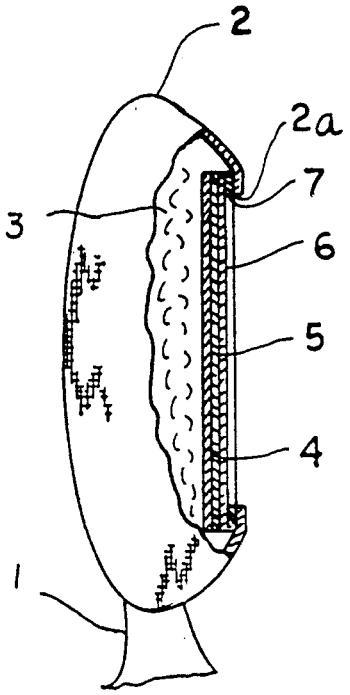

Referring more particularly to FIGS. 1 and 2 of the drawing, numeral 1 denotes a fragmentary head and shoulder portion of a doll of any desired design, having a head portion 2 formed of fabric including a stuffing material 3. At the front of the head portion 2 there is a circular or oblong cut-out or opening *2a* through which is inserted a carboard 4 serving as a backing for a photograph 5 of a face of a child, such as the child who will carry the doll, or perhaps a photograph of the face of a relative, friend, popular movie star or the like. In front of the photograph there is provided a transparent plastic or glass window 6, which window may be either flat or rounded in the form of a lens. A double- faced tape 7 is adhered to the outside of the window 6 and the inside of the opening *2a* to form a permanent seal for the window and photograph.

Figure 3:
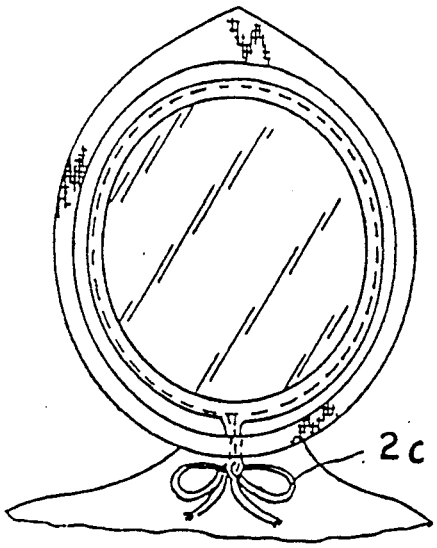
FIG. 3 is a front view.
Figure 4:
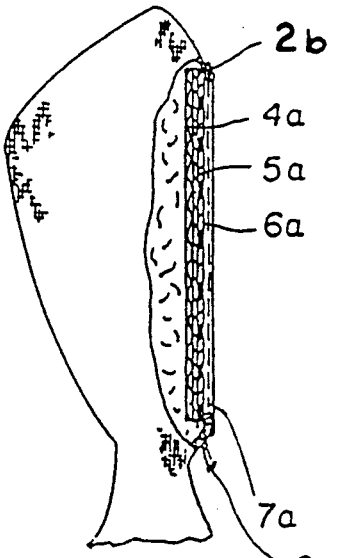
FIG. 4 is a side view of a modification showing the facial photograph being only temporarily enclosed within the window portion.

FIGS. 3 and 4 show a modification including a backing carboard *4a*, a photograph of a child's face *5a* and a transparent window *6a* of either transparent plastic or glass, which window may be either of flat or somewhat lens-shaped.

The transparent section *6a* is enclosed by means of a drawstring *7a* which encircles the periphery *2b* and is tied into a bow *2c*. Such drawstring can be either tied into a temporary bow enabling photograph to be easily and quickly removed and replaced by another photograph, or it may be permanently tied so as to not make the photograph readily replaceable.

While I have described a doll as being the object, it may be an animal, a bird or the like, instead.

Thus it will be seen that I have provided a stuffed doll or the like having a face portion which includes an actual photograph of the child's face, or the face of a relative, friend or popular personality, which will give added enjoyment to the child. Also I have provided a photograph covered by a window portion which forms either a permanent or temporary enclosure, as desired, in the latter case allowing substitution of a number of other facial photographs of a child, to be replaced at will.

I claim:

1. A toy doll having a facial portion comprising a cut-out opening having an inside perimetrical surface which includes a sheet of backing material, an actual photograph of the face of a chile supported by said backing material, a transparent window outside of said photograph and backing material, and perimetrical means for permanently enclosing, inside of said cut-out, said backing material, photograph, and transparent window, said perimetrical means comprising a border of oval shape surrounding the perimeter of said window comprising a tape adhered to the outside edge of said window and the inside surface of said cut-out opening to form a perimetrical seal for said window and photograph.

* * * * *